United States Patent [19]

Carlsson

[11] Patent Number: 4,925,375

[45] Date of Patent: May 15, 1990

[54] DEVICE FOR AUTOMATIC CIRCULATION IN A WASTE WATER PUMP STATION

[75] Inventor: Valdemar Carlsson, Solna, Sweden

[73] Assignee: Flygt AB, Solna, Sweden

[21] Appl. No.: 369,786

[22] Filed: Jun. 22, 1989

[30] Foreign Application Priority Data

Sep. 13, 1988 [SE] Sweden ..... 8803213-1

[51] Int. Cl.[5] ..... F04B 21/00

[52] U.S. Cl. ..... 417/430; 137/505.13; 251/57; 417/299

[58] Field of Search ..... 137/505.13, 505.47; 251/57; 417/430, 299; 415/11

[56] References Cited

U.S. PATENT DOCUMENTS

| | | | |
|---|---|---|---|
| 3,039,733 | 6/1962 | Mattioli | 251/57 X |
| 3,223,116 | 12/1965 | Criddle | 137/505.13 |
| 3,900,045 | 8/1975 | Murrell | 137/505.47 |
| 4,462,766 | 7/1984 | Carlsson | 417/430 |

*Primary Examiner*—Robert G. Nilson

*Attorney, Agent, or Firm*—Menotti J. Lombardi

[57] ABSTRACT

A device is provided for obtaining automatic circulation in waste water pump stations. At the pressure side of the pump unit, there is a valve which opens during certain times to form a connection between the pump and the pump station to create a circulation. The valve is opened and closed by means of communicating bellows which are controlled by the pressure difference between two sections in the valve having different areas.

12 Claims, 1 Drawing Sheet

DEVICE FOR AUTOMATIC CIRCULATION IN A WASTE WATER PUMP STATION

BACKGROUND OF THE INVENTION

The invention concerns a device for providing circulation in pump stations which are included as part of a municipal sewage system.

As is described in U.S. Pat. No. 4,462,766, issued July 31, 1984, sludge banks occur in pump stations and other tanks in a sewage system due to poor circulation. A sludge bank can cause a number of problems, including bad odors, risk of explosions, corrosion problems, etc. As indicated in Swedish Patent Application No. 7908743-3, the problems have been solved by arranging a valve in the pump outlet. The valve is opened temporarily to obtain a circulation and flushing in the pump station, causing the sludge banks to be dissolved and the fluid homogenized.

The adjustment of the valve has up to now been electrically controlled by means of a linear motor which acts upon a slide in the valve. A disadvantage with this solution, in addition to its relatively high cost, is that it may easily become clogged as the pumped medium normally contains large amounts of solid bodies such as stones, rags and other objects. If a stone becomes stuck in the valve slide, the electric motor may stall and burn out or break down.

SUMMARY OF THE INVENTION

An object of the invention is to provide a device for automatic circulation in a waste water pump station.

Another object of the invention is to provide a valve device which is simple, reliable and less sensitive to clogging.

According to the broader aspects of the invention, the valve located on the pressure side of the pump is opened and closed by means of communicating bellows which are controlled by pressure differences between two sections of the valve having different areas.

BRIEF DESCRIPTION OF THE DRAWINGS

Other objects, features and advantages of the present invention will become more fully apparent from the following detailed description of the preferred embodiment, the appended claims and the accompanying drawings in which

DETAILED DESCRIPTION OF THE PREFERRED EMBODIMENT

Figure 1:
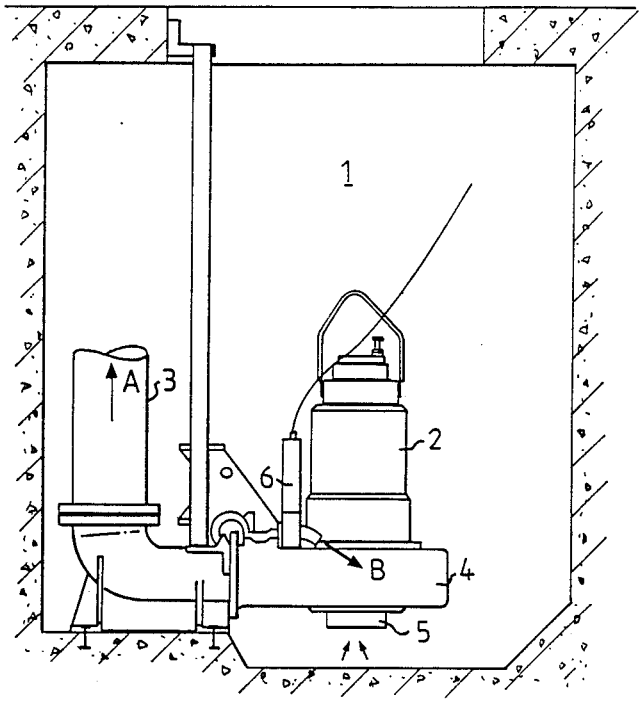
FIG. 1 shows a pump station with a pump unit and attached valve device.

Referring to FIG. 1, a pump station 1 has a submersible pump unit 2 which is connected to a pressure pipe 3. Pump housing 4 has an inlet 5, and amounted mixing valve device 6. Referring additionally to FIGS. 2 and 3, the devise has a pipe portion 7 with two different sections 9 and 10, an outlet 8 and bellows 11, 12. A connection line 13 is coupled to the valve device. The valve devices includes a valve seat 14 having a cam surface 15. The bellows 12 may include a sealing lip 16 as shown in FIG. 3A.

The device operates as follows: Normally the valve device 6 is closed and the pumped medium is transported from the pump housing 4 into the pressure pipe 3. The flow direction is shown by the Arrow A.

During certain times, for instance at pump start up, the valve device is open, which means that a certain amount of the pumped medium flows through the valve device in direction shown by arrow B to obtain a strong agitation in the pump station in order to disrupt possible sludge banks. After a certain time, the valve is closed and the pump continues in the normal manner.

Figure 2A:
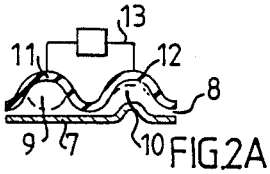
FIGS. 2 and 2A show the principle of the valve device in the opened and closed conditions.
Figure 2:
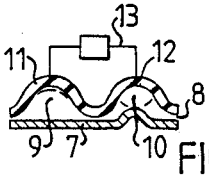
Figure 3:
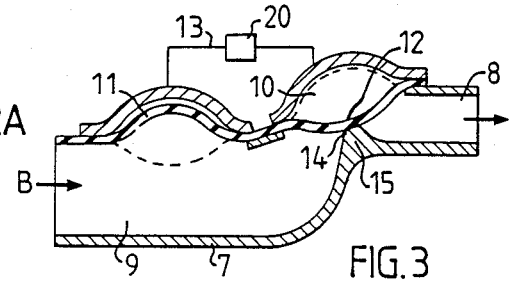
FIGS. 3 shows enlarged view of the valve device according to the invention.
Figure 3A:
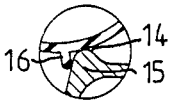
FIG. 3A shows in a partial view an alternate configuration of the valve device of FIG. 3.

The valve device 6 as shown in FIGS. 2, 2A comprises a pipe portion 7, and an outlet 8. The pipe portion 7 is connected to the pump housing, and is designed with two pipe sections 9 and 10 having different areas. Within these sections bellows 11 and 12 are arranged in a closed liquid system. In its expanded (FIG. 2) position, bellows 12 closes the smaller area section 10. The larger area section 9 is partly closed by bellows 11 in its expanded (FIG. 2A) position. The two bellows are activated by an actuator thru line 13, and alternately assume the expanded positions (shown in dotted lines). It is important that the volume of fluid acted upon by bellows 11 in the larger section 9 is greater than or at least of the same volume as compared with the volume of fluid acted upon by the bellows 12 in the smaller section 10. In addition, that portion of the area 9, which is not closed by the bellows 11, must be larger than the total area of section 10.

Under the condition that the fluid in the closed fluid system is allowed to flow freely, the bellows 11 will take an expanded (FIG. 2A) position due to the fact that there is a pressure difference between the two sections 9 and 10. As the latter section 10 has an area which is considerably smaller than the former section 9, the velocity of the fluid will be higher and thus the pressure lower. This difference exists as long as there is a flow through the part 7.

The situation described above will prevail as long as the mixer valve device does not operate, during normal pumping. In order to keep the position of the bellows 12 closed in section 10, when there is no flow, a non-return valve 20 is positioned in the line 13 between the bellows. Said valve will, in a closed position prevent return flow through the bellows 12.

As is evident in FIG. 3 details, the portion of section 10 in front of and to the left of the bellows 12 as well as within said bellow the pump pressure controls. After, to the right of the bellows 12, on the other hand, atmospheric pressure prevails. In order to insure a good sealing between the bellows 12 and its seat 14, the seat has a cam formed surface 15 which prevents bellows 12 from rolling toward to the right as viewed in FIG. 3. According to the alternate solution in FIG. 3A, the bellows 12 is provided with a sealing lip 16, which further insures effective sealing.

When the pump does not operate and there is no flow through the sections 9 and 10, there is equal pressure in these sections. The bellows then take their rest positions which means (as shown in dotted lines) expanded position for the bellows 11 and a non-expanded position for the bellows 12. In order to obtain a flow through the valve during a certain time after start of the pump, a valve is arranged, possibly combined with the previous mentioned non-return valve in the closed system, which prevents flow in the direction from the bellows 11 towards the bellows 12, but allows flow in the opposite direction. This means that, when the pump starts and a flow is created through the part 7 causing the pressure difference between the sections 9 and 10, the higher pressure in section 9 will not be able to act upon the bellows 12 to close the section 10. When the non-return valve 20 is opened, the pressure difference between the two sections 9 and 10 will cause an opening of the passage through section 10. The impulse to open the non-return valve is given after a predetermined time.

The valve device when arranged in a pump station operates in the following manner. In rest position, i.e., when the pump does not operate, the bellows 11 takes an expanded (dotted line) position and the bellows 12 a non-expanded (dotted line) position. The valve device in the closed system, in which the bellows 11 and 12 are parts, takes a position such that flow from the bellows 11 into the bellows 12 is stopped. When the pump starts, the flow through the part 7 of the mixing valve begins and obtains the mixing within the pump station. After a predetermined time the valve in the closed system is opened allowing the fluids therein to flow freely. Because of the fact that there is a lower pressure in the section 10, the fluid will now flow from the bellows 11 into the bellows 12, which then expands and closes the section 10. This means that the mixing valve is now closed and normal pumping takes place until the pump stops. At restart the cycle is repeated.

The valve means in the closed system may be designed as an electromechanically monitored two position valve, but also other mechanically monitored means may be used.

According to the invention is obtained a very simple and reliable device for monitoring mixer valves in pump stations for waste water, which valve is very unsensitive to pollutions in the waste water.

While the present invention has been disclosed in connection with a preferred embodiment thereof, it should be understood that there may be other embodiments which fall within the spirit and scope of the inventions as defined by the following claims:

What is claimed is:

1. In a pumping station containing a submersible pump unit and a valve device which during a limited time period, connects the pressure side of the pump with the pump station for circulation of the pumped medium, said valve device (6) comprising a pipe formed part (7) with an inlet and an outlet nozzle, the part (7) having a first section area (9) and a second section area (10), said first and second section area being different and positioned between the inlet and outlet nozzles; and first closing means (11) and second closing means (12) which are respectively arranged within said first and second section areas to entirely or partly close the respective section area (9) and section area (1), said first closing means (11) and second closing means (12) communicating and cooperating such that when the section area (9) is open, the section area (10) is closed, and when the section area (10) is opened, the section area (9) is partly closed.

2. A device according to claim 1, wherein said first closing means (11) and said second closing means (12) are liquid filled bellows which are coupled by means of a connection line (13).

3. A device according to claim 2, wherein said connection line (13) includes a non-return valve (20).

4. A device according to claim 3 wherein closing of the valve device by the second closing means (12) starts automatically as a result of the pressure difference between the first section area (9) and the second section area (10) of the device as soon as the connection line (13) between the first closing means (11) and second closing means (12) is opened.

5. A device according to claim 1, wherein the second closing means (12) in its expanded position seals against a valve seat (14) formed in said part (7) as a cam surface (15), the second closing means (12) abutting the cam surface (15) on the side turned towards the first section area (9).

6. A device according to claim 5, wherein the second closing means (12) is provided with a sealing lip (16) abutting said cam surface (15).

7. A device according to claim 1 wherein the first section area (9) is larger than the second section area (10).

8. An improved valve device for use in a pumping station containing a submersible pump unit, said valve device connects, during a limited time period, the pressure side of the pump with the pump station for circulation of the pumped medium, the improvement comprising a pipe formed part (7) with an inlet and an outlet nozzle, the part (7) having a first section area (9) and a second section area (10) said first and second section areas being different and positioned between said inlet and outlet nozzles; first closing means (11) and second closing means (12) are arranged respectively within said first and second section areas of said part to entirely or partly close the first section area (9) and the second section area (10), said first closing means (11) and second closing means (12) communicating and cooperating such that when the first section area (9) is open, the second section area (10) is closed, and when the second section area (10) is opened, the first section area (9) is partly closed; and said first closing means (11) and said second closing means (12) are liquid filled bellows which are coupled by means of a connection line (13).

9. A device according to claim 8, wherein closing of the valve device by the second closing means (12) starts automatically as a result of the pressure difference between the first section area (9) and second section area (10) of the device as soon as the connection line (13) between the first closing means (11) and the second closing means (12) is opened.

10. A device according to claim 9, wherein the second closing means (12) in its expanded position seals against a valve seat (14) formed in said part (7) as a cam surface (15), the second closing means (12) abutting the cam surface (15) on the side turned towards the first section area (9).

11. A device according to claim 10, wherein the second closing means (12) is provided with a sealing lip (16) abutting the cam surface (15).

12. A device according to claim 11 wherein the first section area (9) is larger than the second section area (10).

* * * * *